US011620933B2

(12) United States Patent
Orio et al.

(10) Patent No.: US 11,620,933 B2
(45) Date of Patent: Apr. 4, 2023

(54) IR-DROP COMPENSATION FOR A DISPLAY PANEL INCLUDING AREAS OF DIFFERENT PIXEL LAYOUTS

(71) Applicant: Synaptics Incorporated, San Jose, CA (US)

(72) Inventors: Masao Orio, Tokyo (JP); Takashi Nose, Kanagawa (JP); Hirobumi Furihata, Tokyo (JP); Akio Sugiyama, Tokyo (JP); Tomoo Minaki, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 17/069,384

(22) Filed: Oct. 13, 2020

(65) Prior Publication Data

US 2022/0114942 A1 Apr. 14, 2022

(51) Int. Cl.
*G09G 3/20* (2006.01)

(52) U.S. Cl.
CPC ... *G09G 3/2092* (2013.01); *G09G 2300/0452* (2013.01); *G09G 2300/0465* (2013.01); *G09G 2310/0275* (2013.01); *G09G 2320/0233* (2013.01); *G09G 2320/0285* (2013.01)

(58) Field of Classification Search
CPC ..... G09G 3/2092; G09G 2300/0452; G09G 2300/0465; G09G 2310/0275; G09G 2320/0233; G09G 2320/0285; G09G 3/3291; G09G 2320/0673; G09G 2340/0407; G09G 2360/16; G09G 3/3208; G09G 3/32; G09G 2320/0626; G09G 5/10; G09G 3/4023; G09G 2310/0264; G09G 2340/0457
See application file for complete search history.

(56) References Cited

U.S. PATENT DOCUMENTS 10,720,088 B1 * 7/2020 Li ..... G09G 3/2007
10,762,828 B1 * 9/2020 Ma ..... G09G 3/2092
2006/0267880 A1 * 11/2006 Jeon ..... G09G 3/22 345/75.2
2006/0267881 A1 * 11/2006 Jeon ..... G09G 3/22 345/75.2
2007/0030697 A1 * 2/2007 Kim ..... G09G 3/342 362/618
2010/0231810 A1 * 9/2010 Itoh ..... G09G 3/3666 348/731
2010/0309194 A1 * 12/2010 Shin ..... G09G 3/3426 315/294

(Continued)

*Primary Examiner* — Jose R Soto Lopez
(74) *Attorney, Agent, or Firm* — Ferguson Braswell Fraser Kubasta PC

(57) ABSTRACT

A display driver includes image processing circuitry and driver circuitry. The image processing circuitry is configured to process first image data for pixels of a display panel comprising a first region and a second region to generate output voltage data. The first region and the second region have different pixel layouts. The driver circuitry is configured to update the pixels based on the output voltage data. Processing the first image data comprises IR-drop compensation based on first luminances of the pixels, each of the first luminances being determined based on the first image data and whether a corresponding pixel of the pixels is located in the first region.

18 Claims, 16 Drawing Sheets

(56) References Cited

U.S. PATENT DOCUMENTS

2011/0134160 A1* 6/2011 Okishiro ..... H04N 9/69 345/690
2011/0148910 A1* 6/2011 Botzas ..... G09G 5/02 345/694
2014/0085279 A1* 3/2014 Shiomi ..... G09G 3/3666 345/204
2015/0097872 A1* 4/2015 Jeong ..... G09G 3/3225 345/77
2015/0310808 A1* 10/2015 Lee ..... G09G 3/2007 345/77
2015/0356942 A1* 12/2015 Kanda ..... G09G 3/3233 345/212
2016/0049113 A1* 2/2016 Park ..... G09G 3/3208 345/212
2016/0343304 A1* 11/2016 Hwang ..... G09G 3/3225
2018/0075804 A1* 3/2018 Kim ..... G09G 3/3233
2018/0130421 A1* 5/2018 Zhou ..... G09G 3/3266
2018/0166003 A1* 6/2018 Wang ..... G06T 5/003
2018/0166018 A1* 6/2018 Yang ..... G09G 3/3266
2018/0268759 A1* 9/2018 Wang ..... G09G 3/3258
2019/0109184 A1* 4/2019 Li ..... H01L 27/3248
2019/0304359 A1* 10/2019 Liu ..... G09G 3/3225
2019/0333433 A1* 10/2019 Zhu ..... G09G 3/20
2019/0340974 A1* 11/2019 Ka ..... G09G 3/3233
2019/0340980 A1* 11/2019 Yum ..... G09G 3/3225
2019/0378457 A1* 12/2019 Shen ..... G09G 3/3258
2020/0043402 A1* 2/2020 Omid-Zohoor ..... G09G 3/3648
2020/0058728 A1* 2/2020 Song ..... H01L 27/3265
2020/0111423 A1* 4/2020 Orio ..... G09G 3/3291
2020/0126497 A1* 4/2020 Wang ..... G09G 3/3648
2020/0135832 A1* 4/2020 Ma ..... G09G 3/20
2020/0168141 A1* 5/2020 Ma ..... G09G 3/035
2020/0234634 A1* 7/2020 Li ..... G09G 3/3208
2020/0286426 A1* 9/2020 Li ..... H01L 27/3276
2020/0294469 A1* 9/2020 Kim ..... G09G 5/00
2020/0312209 A1* 10/2020 Yang ..... G09G 3/20
2020/0335023 A1* 10/2020 Yen ..... G09G 3/20
2020/0335043 A1* 10/2020 Zhao ..... G09G 3/3225
2020/0410940 A1* 12/2020 Kim ..... G09G 3/20
2021/0020098 A1* 1/2021 Yum ..... G09G 3/3208
2021/0056906 A1* 2/2021 Lee ..... G09G 3/3258
2021/0065606 A1* 3/2021 Park ..... G09G 3/20
2021/0065625 A1* 3/2021 Wang ..... G09G 3/2074
2021/0151517 A1* 5/2021 Zhu ..... H01L 51/5265
2021/0183334 A1* 6/2021 Holland ..... G09G 5/001
2021/0193047 A1* 6/2021 Kwon ..... G09G 3/3258
2021/0217347 A1* 7/2021 Li ..... G09G 3/2003
2021/0304677 A1* 9/2021 Yang ..... G09G 3/2003

* cited by examiner

IR-DROP COMPENSATION FOR A DISPLAY PANEL INCLUDING AREAS OF DIFFERENT PIXEL LAYOUTS

FIELD

The disclosed technology generally relates to a display driver, display device and method for driving a display panel with different pixel layouts.

BACKGROUND

A display panel may include regions with different pixel layouts. For example, a display panel adapted to an under-display (or under-screen) camera may include a low pixel-per-inch (PPI) region in which the pixel-per-inch or pixel density is reduced compared to the remaining region. The low PPI region may be configured to allow the under-display camera to acquire an image through the low PPI region.

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In one or more embodiments, a display driver is provided. The display driver includes image processing circuitry and driver circuitry. The image processing circuitry is configured to process first image data for pixels of a display panel comprising a first region and a second region to generate output voltage data. The first region and the second region have different pixel layouts. The driver circuitry is configured to update the pixels based on the output voltage data. Processing the first image data comprises IR-drop compensation based on first luminances of the pixels, each of the first luminances being determined based on the first image data and whether a corresponding pixel of the pixels is located in the first region.

In one or more embodiments, a display device is provided. The display device includes a display panel and a display driver. The display panel includes a first region and a second region having different pixel layouts. The display driver is configured to process first image data for pixels of the display panel to generate output voltage data. The drive circuitry is configured to update the pixels based on the output voltage data. Processing the first image data includes IR-drop compensation based on first luminances of the pixels of the display panel, each of the first luminances being determined based on the first image data and whether a corresponding pixel of the pixels is located in the first region.

In one or more embodiments, a method for driving a display panel is provided. The method includes processing first image data for pixels of a display panel comprising a first region and a second region to generate output voltage data, the first region and the second region having different pixel layouts. The method further includes updating the pixels based on the output voltage data. Processing the first image data includes IR-drop compensation based on first luminances of the pixels, each of the first luminances being determined based on the first image data and whether a corresponding pixel of the pixels is located in the first region.

Other aspects of the embodiments will be apparent from the following description and the appended claims.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
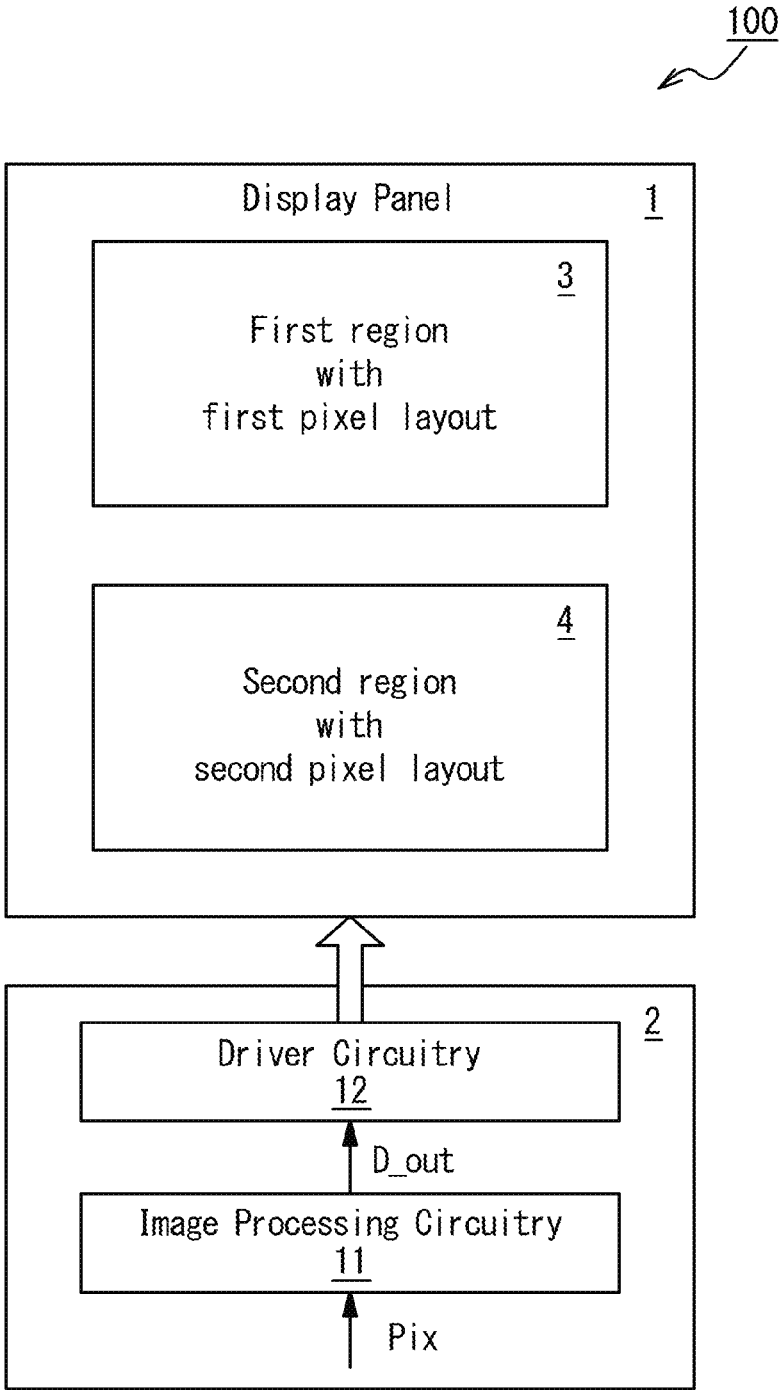
FIG. 1 illustrates an example configuration of a display device, according to one or more embodiments.

To facilitate understanding, identical reference numerals have been used, where possible, to designate identical elements that are common to the figures. It is contemplated that elements disclosed in one embodiment may be beneficially utilized in other embodiments without specific recitation. Suffixes may be attached to reference numerals for distinguishing identical elements from each other. The drawings referred to herein should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

A display panel may include two or more regions of different pixel layouts. The pixel layout difference may include a difference in one or more of the size, configuration, arrangement, and number of subpixels in each pixel. The pixel layout difference may additionally or instead include a difference in the arrangement of pixels. In one example, a display panel may include a camera hole region under which an under-display camera is disposed. The camera hole region may be configured to have a reduced pixel-per-inch (PPI) or pixel density to allow the under-display camera to capture an image through the camera hole region, while a different region of the display panel is configured to display an image with an increased pixel density.

Meanwhile, a display panel that includes pixels configured to operate on a power supply voltage may experience display mura caused by a voltage drop over a power source line that delivers the power supply voltage to the pixels within the display panel. Such voltage drop may be hereinafter referred to as IR-drop. Examples of a display panel that experiences IR-drop may include an organic light emitting diode (OLED) display panel and a micro light emitting diode (LED) display panel.

IR-drop compensation is a technique for addressing display mura caused by the IR-drop. The IR-drop compensation may involve processing image data to mitigate the effect of the IR-drop, where the image data may include grayscale values associated with respective subpixels (e.g., red, green, and blue subpixels) for each pixel. The effect of the IR-drop may depend on the total current of the display panel and the location in the display panel, and therefore the IR-drop compensation for a pixel may be based on the total current of the display panel and the location of the pixel in the display panel. The total current of the display panel may be the sum of currents traveling through the respective pixels.

The present disclosure provides various techniques for IR-drop compensation for a display panel that includes two or more regions with different pixel layouts. To achieve the same luminance in different regions with different pixel layouts for a fixed grayscale value, the currents traveling through the pixels in the different regions for the fixed grayscale value may need to be different depending on the pixel layouts. The present disclosure offers techniques for determining currents travelling through respective pixels of the display panel with reduced hardware.

FIG. 1 illustrated an example overall configuration of a display device 100, according to one or more embodiments. In the illustrated embodiment, the display device 100 includes a display panel 1 and a display driver 2. Display panel 1, such as OLED display panels and micro LED display panels, may experience the above-discussed IR-drop.

The display panel 1 may be configured to include a first region 3 with a first pixel layout and a second region 4 with a second pixel layout that is different from the first pixel layout. The first pixel layout and the second pixel layout may be different in the size, configuration, arrangement of the pixels. In addition to or instead of this, the first pixel layout and the second pixel layout may be different in the pixel density (e.g., as measured by pixel-per-inch (PPI)). The pixel density of the first pixel layout may be lower than the pixel density of the second pixel layout. The first pixel layout and the second pixel layout may be additionally or instead different in the size, configuration, arrangement and/or number of subpixels in each pixel. The subpixels in the first region 3 and the second region 4 may include different types of light emitting elements (e.g., OLEDs and micro LEDs).

The display driver 2 includes image processing circuitry 11 and driver circuitry 12. The image processing circuitry 11 is configured to process input image data Pix to generate output voltage data D_out. The input image data Pix may include grayscale values that specify the graylevels of respective colors (e.g., red, green, and blue) of each pixel in the displayed image. The output voltage data D_out may include voltage values that specify the voltages with which subpixels of each pixel in the display panel 1 are to be updated. The driver circuitry 12 is configured to update the pixels based on the output voltage data D_out.

In one or more embodiments, the processing performed by the image processing circuitry 11 includes IR-drop compensation based on luminances of the pixels. Each pixel has a corresponding luminance. Each of the luminances is determined based, at least in part, on the input image data D_in and whether a corresponding pixel of the pixels is located in the first region 3. In embodiments where the current traveling through a pixel determines the luminance of the pixel, the luminances thus determined will correspond to currents traveling through the pixels with an improved accuracy, and therefore the IR-drop compensation based on the luminance thus determined may improve the accuracy of the IR-drop compensation.

Figure 2:
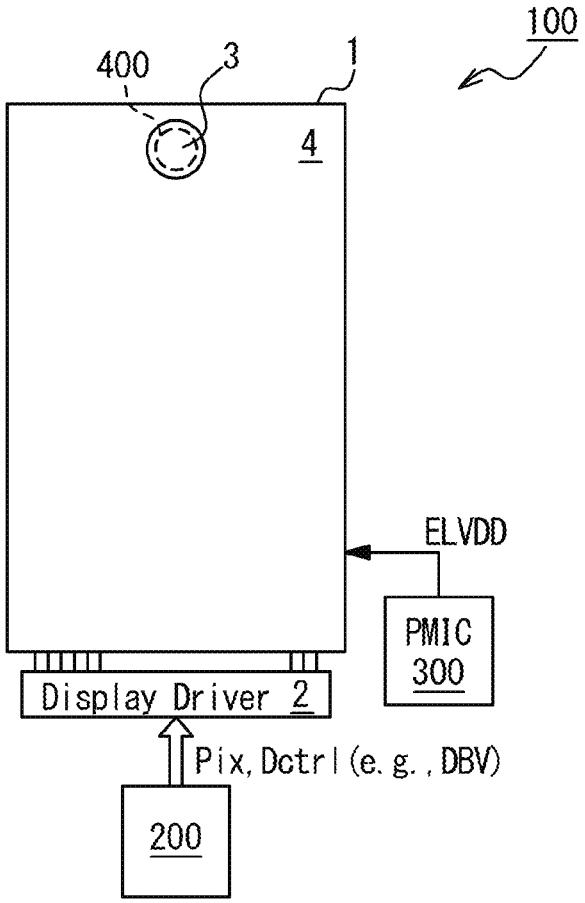
FIG. 2 illustrates an example implementation of the display device, according to one or more embodiments.

FIG. 2 illustrates an example implementation of the display device 100, according to one or more embodiments. In the illustrated implementation, the display device 100 is configured to display an image corresponding to input image data Pix received from an entity 200 external to the display device 100. Examples of the entity 200 may include an application processor, a central processing unit (CPU), a host, and other processors suitable for controlling the display device 100. The display device 100 may be further configured to receive control data Dctrl from the entity 200 to control the operation of the display device 100. The control data Dctrl may include a display brightness value (DBV) used to control the display brightness level of the display device 100. The display brightness level may be the overall brightness level of the image displayed by the display device 100.

In the illustrated embodiment, the display device 100 includes a display panel 1 and a display driver 2. The display panel 1 is configured to receive a power supply voltage ELVDD from a power management IC (PMIC) 300 and deliver the power supply voltage ELVDD to respective subpixels of respective pixels (not illustrated in FIG. 2) through power source lines. In other embodiments, the display panel 1 may be configured to receive the power supply voltage ELVDD from the display driver 2.

The display panel 1 includes a first region 3 and a second region 4 which have different pixel layouts. In the illustrated embodiment, the first region 3 has a lower pixel density than the second region 4, and the first region 3 is used as a camera hole region under which a camera 400 is disposed. The camera 400 is configured to capture an image through the first region 3. This configuration may reduce an effect on the captured image caused by the pixels in the display panel 1.

Figure 3:
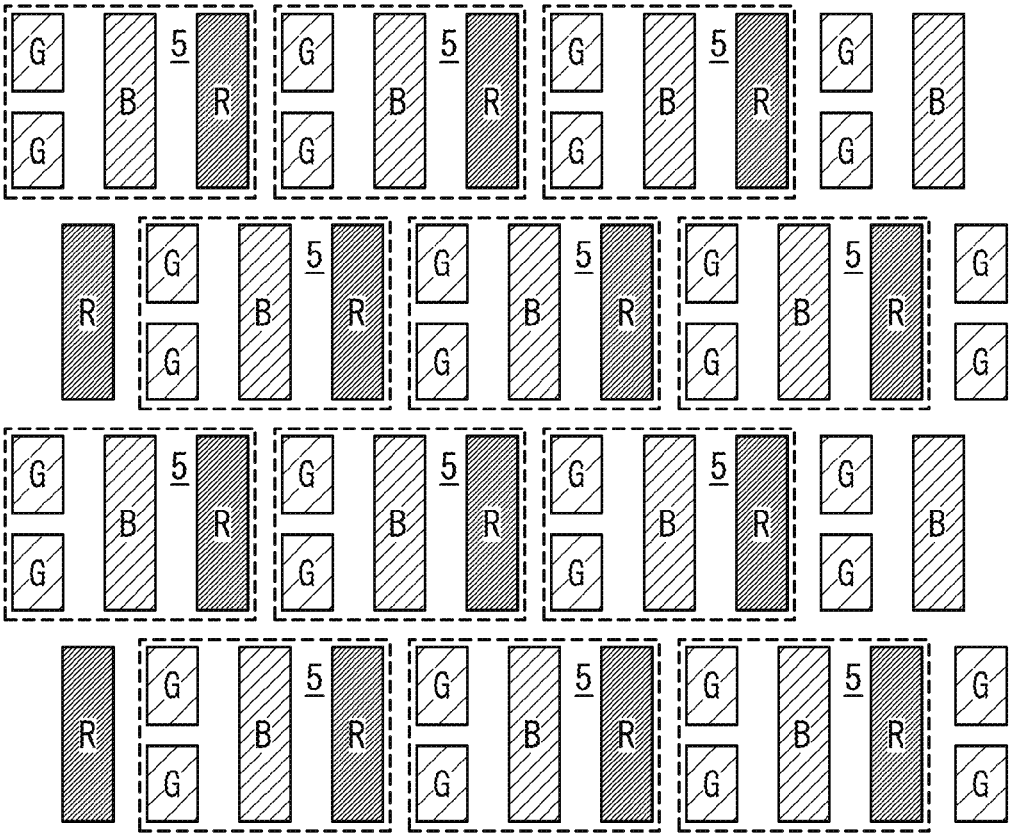
FIG. 3 illustrates an example pixel layout, according to one or more embodiments.

FIG. 3 illustrates an example pixel layout in the second region 4, according to one or more embodiments. The second region 4 may include a plurality of pixels 5 adapted to image data generated through a subpixel rendering (SPR) technique. In the illustrated embodiment, each pixel 5 includes a red (R) subpixel, two green (G) subpixels, and a blue (B) subpixel. In FIG. 3 (and in FIG. 4), "R", "G", and "B" denote red subpixels, green subpixels, and blue subpixels, respectively. The R, G, and B subpixels of the pixels 5 are each configured to be updated with an output voltage received from the display driver 2. The R, G, and B subpixels of the pixels 5 are each further configured to operate on the power supply voltage ELVDD supplied to the display panel 1 and emit light of a luminance corresponding to the output voltage.

Figure 4:
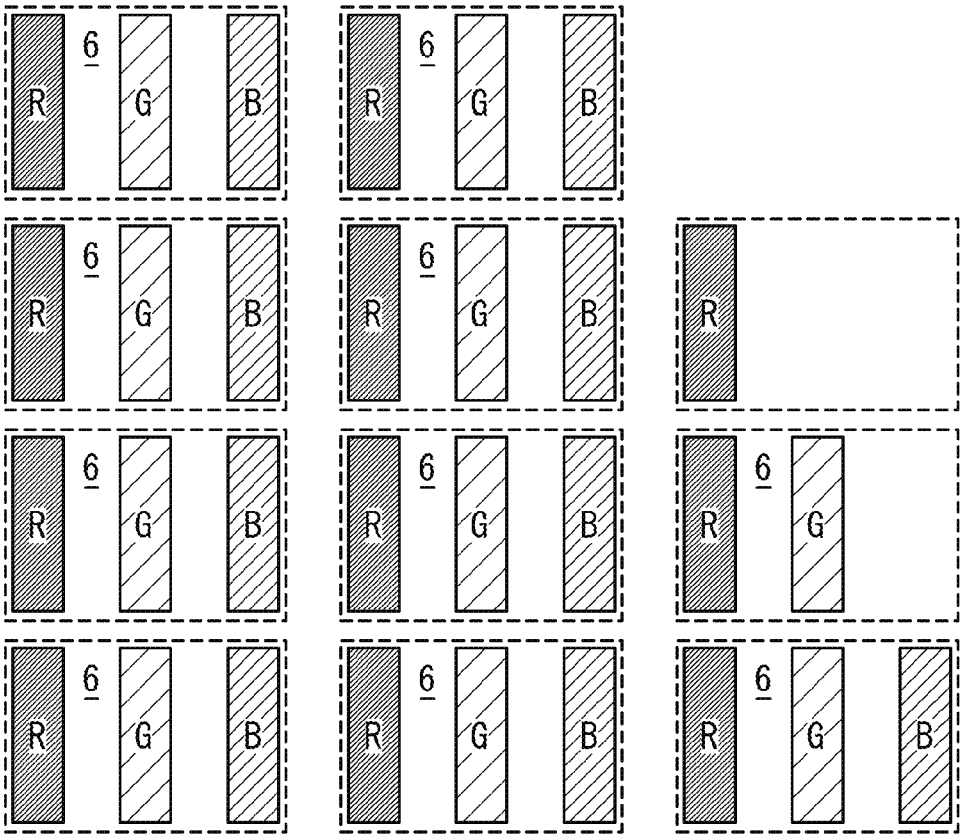
FIG. 4 illustrates another example pixel layout, according to one or more embodiments.

FIG. 4 illustrates an example pixel layout in the first region 3, according to one or more embodiments. In the illustrated embodiment, the first region 3 may include a plurality of pixels 6 adapted to image data in an RGB format, configured differently from the pixels 5 disposed in the second region 4. In the illustrated embodiment, each pixel 6 of the first region 3 includes one R subpixel, one G subpixel, and one B subpixel, while each pixel 5 of the second region 4 includes one R subpixel, two G subpixel, and one B subpixel as illustrated in FIG. 3. The pixels 6 are arranged such that the pixel density in the first region 3 is lower than that in the second region 4. In one implementation, the spacing between two adjacent subpixels in the first region 3 is larger than that in the second region 4. The R, G, and B subpixels of the pixels 6 are each configured to be updated with an output voltage received from the display driver 2 similarly to the subpixels in the pixels 5. The R, G, and B subpixels of the pixels 6 are further configured to operate on the power supply voltage ELVDD supplied to the display panel 1 and emit light of a luminance corresponding to the output voltage.

Each of the pixels 5 and/or 6 may further comprise at least one additional subpixel configured to display a color other than red, green, and blue. The combination of the colors of the display elements in each pixel is not limited to that disclosed herein. For example, each pixel may further comprise a subpixel configured to display white or yellow.

The difference in the pixel layout may cause different display characteristics between the first region 3 and the second region 4. In one implementation, the luminance of a pixel 5 in the second region 4 and the luminance of a pixel 6 in the first region 3 are different for the same output voltage.

Figure 5:
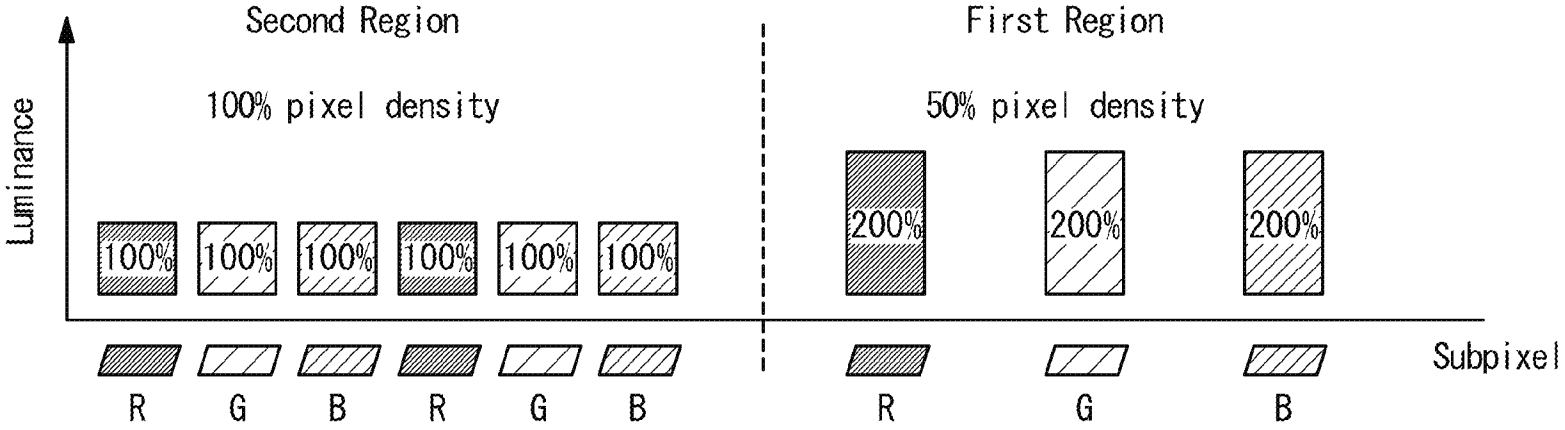
FIG. 5 illustrates example luminances of subpixels for a fixed grayscale value in a first region and a second region, according to one or more embodiments.

FIG. 5 illustrates example luminances of subpixels in the first region 3 and the second region 4 for a fixed grayscale value, according to one or more embodiments. In the illustrated embodiment, the first region 3 has a lower pixel density than that of the second region 4, and the pixel densities of the first region 3 and the second region 4 are normalized such that the pixel density of the second region 4 is 100%. To improve image smoothness at the boundary between the first region 3 and the second region 4 (e.g., avoid an artifact appearing at the boundary between the first region 3 and the second region 4), the luminances of the respective subpixels of the respective pixels 6 in the first region 3 for a fixed grayscale value are increased compared to those in the second region 4. In embodiments where the pixel density of the first region 3 is 50% of the second region 4, the luminances of the respective subpixels of the respective pixels 6 in the first region 3 for a fixed grayscale value may be increased up to 200%, while those of the respective subpixels of the respective pixels 5 in the second region 4 are 100%.

In one or more embodiments, each subpixel of the pixels 5 and 6 is configured such that a current traveling through the subpixel increases as an output voltage supplied to the subpixel decreases and the luminance of the subpixel increases as the current traveling through the subpixel increases. This applies, for example, to embodiments where each subpixel is based on P-channel thin film transistors (TFTs) and includes an OLED element configured to emit light.

Figure 6A:
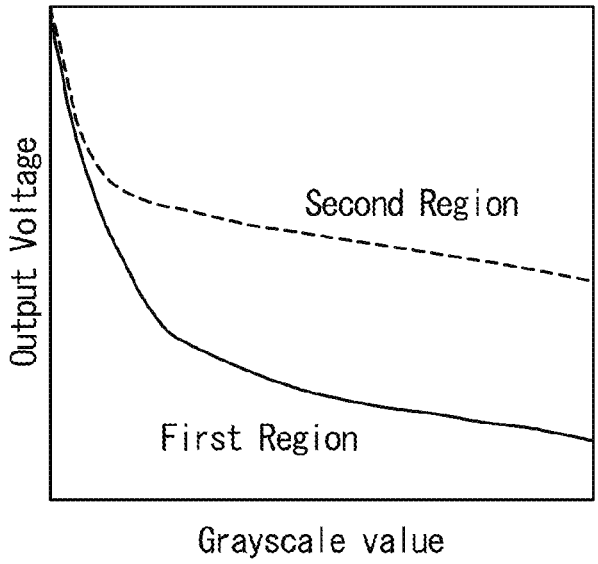
FIGS. 6A and 6B illustrate example gamma characteristics (or input-output characteristics) for a first region and a second region, according to one or more embodiments.
Figure 6B:
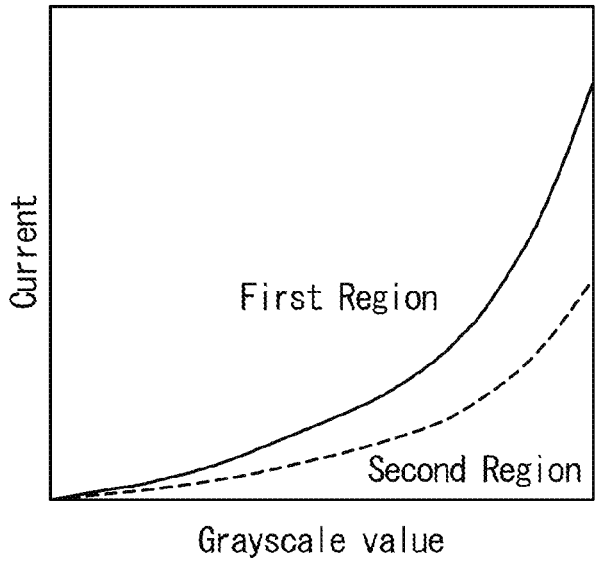

FIG. 6A illustrates example correlations between grayscale values and output voltages to be supplied to the subpixels in the first region 3 and the second region 4, according to one or more embodiments, and FIG. 6B illustrates example correlations between grayscale values and currents traveling through the subpixels in the first region 3 and the second region 4, according to one or more embodiments. In various embodiments, the output voltages supplied to subpixels in the first region 3 and the second region 4 are adjusted to reduce or eliminate the difference in the luminance between the first region 3 and the second region 4. In embodiments where the first region 3 has a lower pixel density than the second region 4, the output voltage supplied to a subpixel in the first region 3 for a fixed grayscale value is lower than that supplied to a subpixel in the second region 4 for the fixed grayscale value as illustrated in FIG. 6A, and the current traveling through the subpixel in the first region 3 for the fixed grayscale value is larger than that traveling through the subpixel in the second region 4 for the fixed grayscale value, as illustrated in FIG. 6B. This may suppress or eliminate an artifact appearing at the boundary between the first region 3 and the second region 4. In one or more embodiments, IR-drop compensation is implemented considering the above-discussed difference in the display characteristics between the first region 3 and the second region 4.

Figure 7:
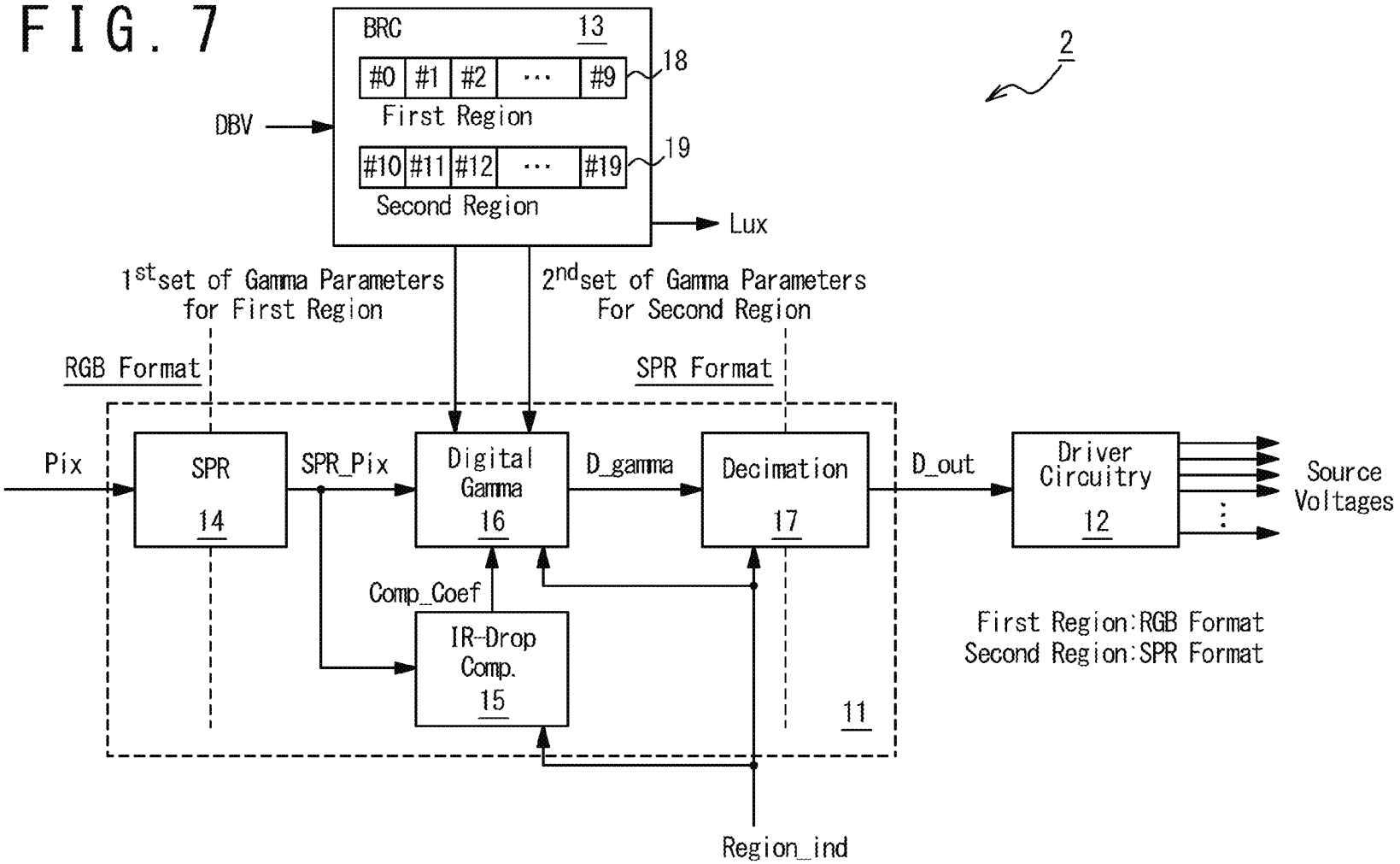
FIG. 7 illustrates an example partial configuration of a display driver, according to one or more embodiments.

FIG. 7 illustrates an example partial configuration of the display driver 2, according to one or more embodiments. In the illustrated embodiment, the display driver 2 comprises image processing circuitry 11, driver circuitry 12, and brightness controller (BRC) 13. The image processing circuitry 11 is configured to process input image data Pix to generate output voltage data D_out indicative of the voltage levels of the output voltages with which the subpixels disposed in the display panel 1 are updated. Generating the output voltage data includes a gamma transformation and an IR-drop compensation as discussed later in detail.

The image processing circuitry 11 includes subpixel rendering (SPR) circuitry 14, IR-drop compensation circuitry 15, digital gamma circuitry 16, and decimation circuitry 17. The SPR circuitry 14 is configured to apply subpixel rendering to the input image data Pix to generate subpixel-rendered image data SPR_Pix. The subpixel-rendered image data SPR_Pix may be generated in a format adapted to the pixel layout of the second region 4. The subpixel-rendered image data SPR_Pix may include grayscale values for an R subpixel, two G subpixels, and a B subpixel for each pixel.

The IR-drop compensation circuitry 15 is configured to generate compensation coefficients Comp_Coef used for the IR-drop compensation for the respective pixels in the display panel 1 based on the subpixel-rendered image data SPR_Pix. The compensation coefficients Comp_Coef are provided to the digital gamma circuitry 16.

The digital gamma circuitry 16 is configured to apply a gamma transformation and an IR-drop compensation to the subpixel-rendered image data SPR_Pix to generate gamma voltage data D_gamma. In one implementation, the gamma voltage data D_gamma is generated in a format adapted to the pixel layout of the second region 4. The gamma voltage data D_gamma may include voltage values for an R subpixel, two G subpixels, and a B subpixel for each pixel. In some embodiments, the gamma transformation converts grayscale values of the subpixel-rendered image data SPR_Pix into voltage values, and the IR-drop compensation modifies the voltage values obtained by the gamma transformation based on the compensation coefficients Comp_Coef to generate the voltage values of the gamma voltage data D_gamma. In other embodiments, the IR-drop compensation may be performed before the gamma transformation. In such embodiments, the IR-drop compensation may modify the grayscale values of the subpixel-rendered image data SPR_Pix, and the gamma transformation converts the modified grayscale values into the voltage values of the gamma voltage data D_gamma.

In one or more embodiments, the gamma transformation is performed such that the correlation between grayscale values and output voltages is different between the first region 3 and the second region 4 (e.g., as discussed in relation to FIGS. 5, 6A and 6B). To achieve this, in one implementation, the digital gamma circuitry 16 is configured to receive a first set of gamma parameters for the first region 3 and a second set of gamma parameters for the second region 4 from the BRC 13. The first set of gamma parameters defines a first correlation between grayscale values and voltage values for the first region 3, and the second set of gamma parameters defines a second correlation between grayscale values and voltage values for the second region 4. The digital gamma circuitry 16 is configured to select one of the first and second sets of the gamma parameters based on a region indication signal Region_ind and apply the gamma transformation in response to the selected set of gamma parameters, where the region indication signal Region_ind is asserted while the image processing circuitry 11 is receiving input pixel data Pix for the first region 3. The digital gamma circuitry 16 is configured to apply the gamma transformation in accordance with the first set of gamma parameters to the subpixel-rendered image data SPR_Pix for the first region 3 and apply the gamma transformation in accordance with the second set of gamma parameters to the subpixel-rendered image data SPR_Pix for the second region 4.

Figure 8A:
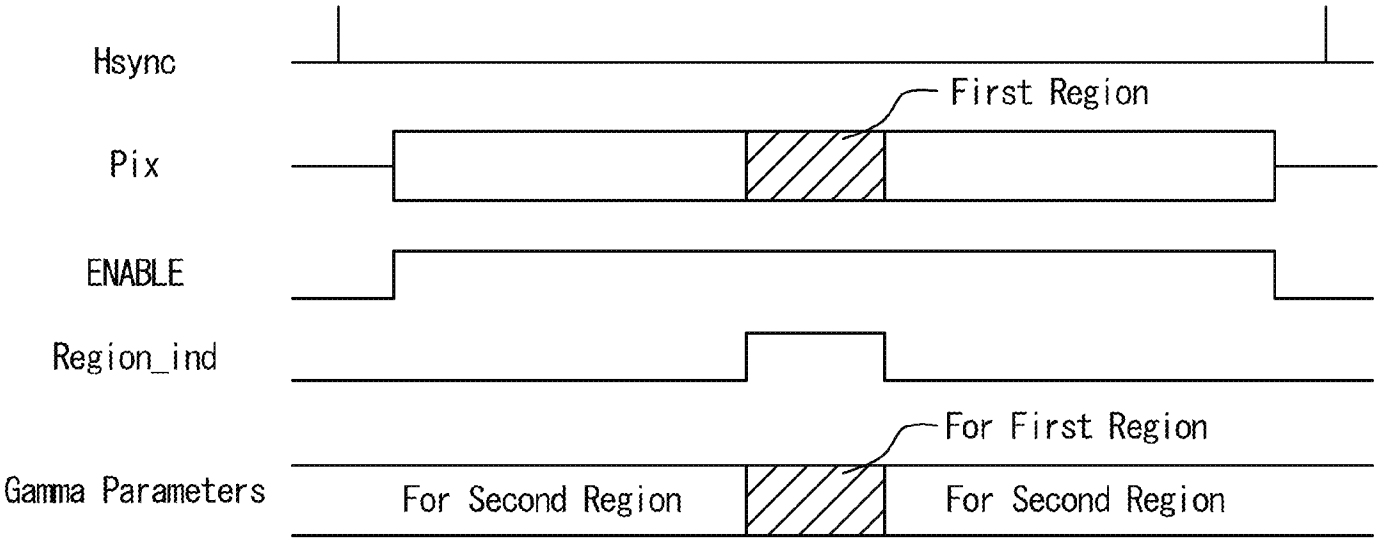
FIG. 8A illustrates an example operation of digital gamma circuitry to update a row of pixels that cross a first region, according to one or more embodiments.
Figure 8B:
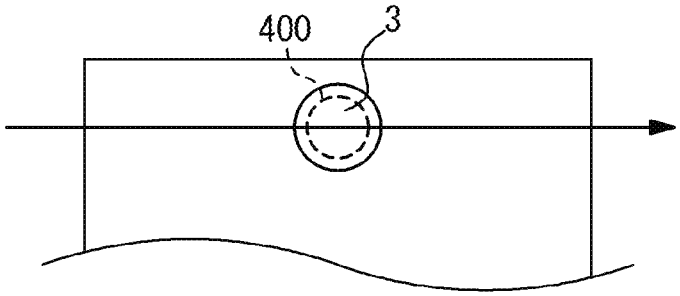
FIG. 8B illustrates a row of pixels that cross a first region, according to one or more embodiments.

FIG. 8A illustrates an example operation of the digital gamma circuitry 16 to update a row of pixels that cross the first region 3 as illustrated in FIG. 8B, according to one or more embodiments. In the embodiment illustrated in FIG. 8A, a series of input image data Pix for the row of pixels are sequentially supplied to the image processing circuitry 11 in synchronization with an assertion of an image data stream enable signal ENABLE and the subpixel-rendered image data SPR_Pix are sequentially generated through subpixel rendering by the SPR circuitry 14. For the pixels 5 in the second region 4, the digital gamma circuitry 16 applies the gamma transformation in accordance with the first set of gamma parameters in response to the region indication signal Region_ind being deactivated. For the pixels 6 in the first region 3, the digital gamma circuitry 16 applies the gamma transformation in accordance with the first set of gamma parameters in response to the region indication signal Region_ind being activated.

Referring back to FIG. 7, the decimation circuitry 17 is configured to generate the output voltage data D_out from the gamma voltage data D_gamma. The decimation is performed differently between the first region 3 and the second region 4. For the pixels 5 in the second region 4, the decimation circuitry 17 is configured to use the gamma voltage data D_gamma as the output voltage data D_out without modification. For the pixels 6 in the first region 3, the decimation circuitry 17 is configured to decimate part of the gamma voltage data D_gamma to generate the output voltage data D_out.

The driver circuitry 12 is configured to generate output voltages based on the output voltage data D_out to update the respective subpixels of the pixels 5 and 6 in the display panel 1. The generated output voltages are supplied to the corresponding subpixels of the pixels 5 and 6 to update or program the same.

The BRC 13 is configured to provide, based on the DBV received from the entity 200, the first and second sets of the gamma parameters defined for the first region 3 and the second region 4 to the digital gamma circuitry 16 of the image processing circuitry 11. In one implementation, the BRC 13 includes a first setting table 18 from which the first set of gamma parameters is selected for the first region 3 and a second setting table 19 from which the second set of gamma parameters is selected for the second region 4. Each of the first setting table 18 and the second setting table 19 includes a plurality sets of gamma parameters. In the illustrated embodiment, the first setting table 18 includes ten sets #0 to #9 of gamma parameters, and the second setting table 19 includes ten sets #10 to #19 of gamma parameters. The BRC 13 is configured to select the first set of gamma parameters from the ten sets #0 to #9 of gamma parameters of the first setting tables 18 for the first region 3 and select the second set of gamma parameters from the ten sets #10 to #19 of gamma parameters of the second setting tables 19 for the second region 4.

The BRC 13 may be further configured to generate a luminance value Lux that specifies a desired display brightness level of the entire displayed image. The DBV may include control information other than information used to control the display brightness level. For example, the DBV may include information of a desired frame rate. In such embodiments, the DBV may not directly indicate the desired display brightness level. In various embodiments, the luminance value Lux is generated by removing the information other than the desired display brightness level from the DBV to directly indicate the desired display brightness level.

Figure 9:
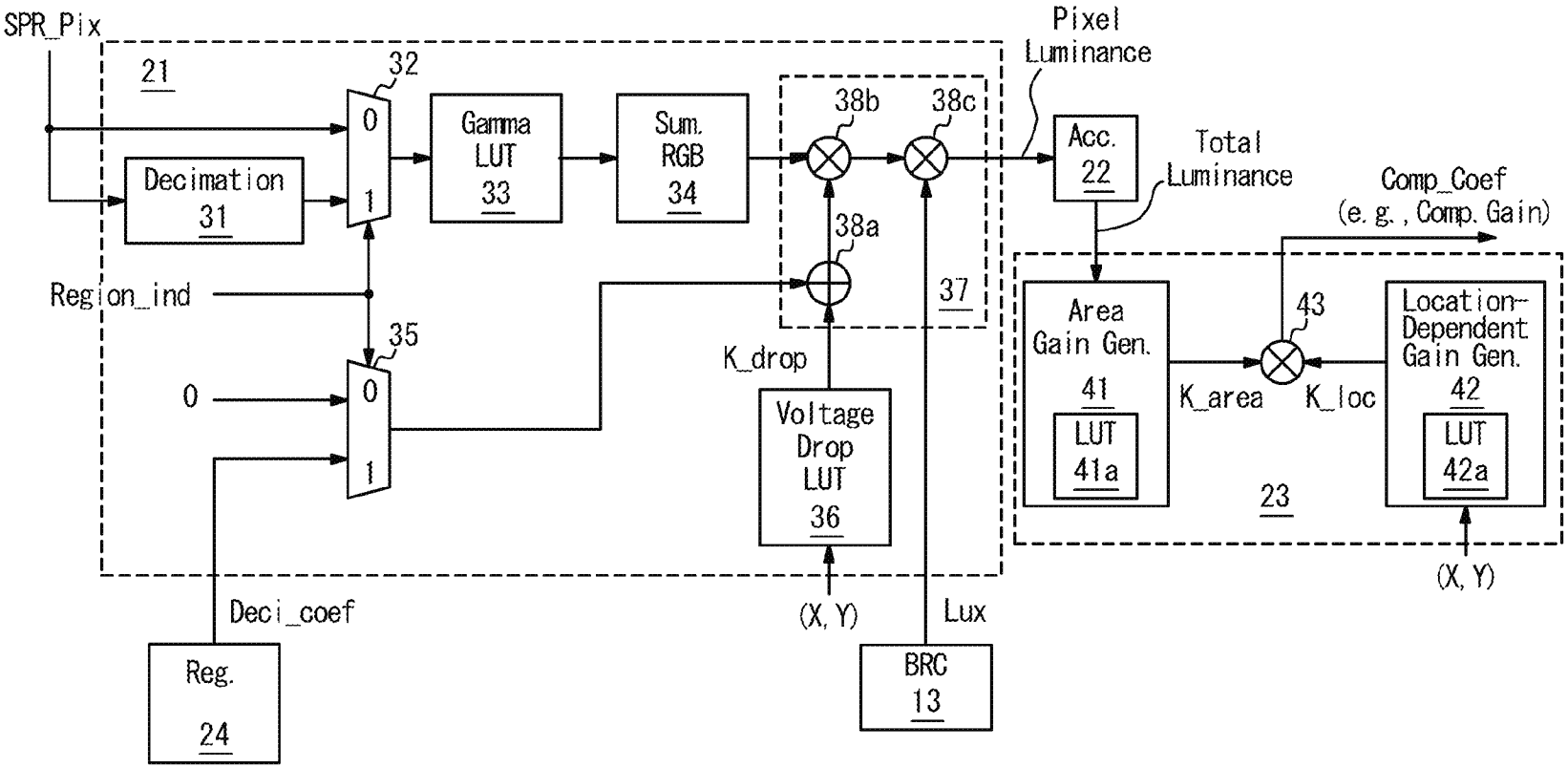
FIG. 9 illustrates an example configuration of IR-drop compensation circuitry, according to one or more embodiments.

FIG. 9 illustrates an example configuration of the IR-drop compensation circuitry 15, according to one or more embodiments. In the illustrated embodiment, the IR-drop compensation circuitry 15 includes pixel luminance determination circuitry 21, accumulator circuitry 22, compensation coefficient determination circuitry 23, and register circuitry 24.

The pixel luminance determination circuitry 21 is configured to determine the pixel luminance for each of the pixels 5 and 6 of the display panel 1 based on the subpixel-rendered image data SPR_Pix and the locations of the respective pixels 5 and 6. The locations of the respective pixels 5 and 6 may be indicated by coordinates (X, Y) defined in the display panel 1.

In the illustrated embodiments, the pixel luminance determination circuitry 21 includes a decimation circuitry 31, a selector 32, gamma lookup table (LUT) circuitry 33, summation circuitry 34, a selector 35, a voltage drop LUT 36, and processing circuitry 37. The decimation circuitry 31 is configured to decimate part of subpixel-rendered image data SPR_Pix. In one implementation, the resultant image data output from the decimation circuitry 31 is in the RGB format, in which each pixel includes one R subpixel, one G subpixel, and one B subpixel.

The selector 32 is configured to output a selected one of the subpixel-rendered image data SPR_Pix and the output image data from the decimation circuitry 31 in response to the region indication signal Region_ind. In one implementation, the selector 32 is configured to select the subpixel-rendered image data SPR_Pix in response to the region indication signal Region_ind being deactivated and select the output image data from the decimation circuitry 31 in response to the region indication signal Region_ind being activated.

The Gamma LUT circuitry 33 is configured to apply a gamma transformation to the selected image data (the subpixel-rendered image data SPR_Pix or the output image data from the decimation circuitry 31) to determine the luminances of the respective subpixels of the pixel of interest through a table lookup on an LUT stored therein for each subpixel of the pixel of interest. The gamma transformation may be implemented to achieve a gamma value of 2.2.

The summation circuitry 34 is configured to sum up the determined luminances of the respective subpixels of the pixel of interest to determine the pixel luminance of the pixel of interest for the maximum display brightness level.

The selector 35 is configured to output a selected one of zero and a decimation coefficient Deci_coef to the processing circuitry 37 in response to the region indication signal Region_ind. In one implementation, the selector 32 is configured to select zero in response to the region indication signal Region_ind being deactivated and select the decimation coefficient Deci_coef in response to the region indication signal Region_ind being activated. The decimation coefficient may be received from register circuitry 24 configured to store the decimation coefficient. The register circuitry 24 may be configured to be accessible from an entity external to the display driver 2 (e.g., the entity 200) to allow the external entity to rewrite the decimation coefficient.

The voltage drop LUT 36 is configured to describe the correspondence relation between the location of the pixel of interest (e.g., the coordinates (X, Y) of the pixel of interest) and a voltage drop compensation gain K_drop. In one or more embodiments, the voltage drop compensation gain K_drop is obtained through a table lookup on the voltage drop LUT 36 with reference to the position (X, Y) of the pixel of interest. In one or more embodiments, the voltage drop compensation gain K_drop is used to compensate an influence of the voltage drop across the power source lines on the current traveling through the pixel of interest.

The processing circuitry 37 is configured to determine the pixel luminance of the pixel of interest, based on the voltage drop compensation gain K_drop, the output of the selector 35 and the luminance value Lux which specifies the desired display brightness level. In one implementation, the processing circuitry 37 is configured to multiply the pixel luminance output from the summation circuitry 34 by a gain determined based on the voltage drop compensation gain K_drop, the output of the selector 35, and the luminance value Lux received from the BRC 13.

In the illustrated embodiment, the processing circuitry 37 includes gain modifier circuitry 38*a* and a pair of multipliers 38*b* and 38*c*. The gain modifier circuitry 38*a* is configured to modify the voltage drop compensation gain K_drop based on the output of the selector 35. When the pixel of interest is located in the second region 4 (e.g., when the region indication signal Region_ind is deactivated), the output of the selector 35 is zero and the gain modifier circuitry 38*a* outputs the voltage drop compensation gain K_drop without modification. When the pixel of interest is located in the first region 3 (e.g., when the region indication signal Region_ind is activated), the output of the selector 35 is the decimation coefficient Deci_coef, and the gain modifier circuitry 38*a* modifies the voltage drop compensation gain K_drop and outputs the modified voltage drop compensation gain K_drop to the multiplier 38*b*. In one implementation, the gain modifier circuitry 38*a* is configured as an adder that adds the output from the selector 35 to the voltage drop compensation gain K_drop. The multiplier 38*b* is configured to multiply the pixel luminance output from the summation circuitry 34 by the output of the gain modifier circuitry 38*a*, and the multiplier 38*c* is configured to multiply the output of the multiplier 38*b* by a multiplying factor that depends on the luminance value Lux. In the illustrated embodiment, the overall gain of the processing circuitry 37 is the product of the original voltage drop compensation gain K_drop and the multiplying factor for the pixels 5 in the second region 4, and the product of the modified voltage drop compensation gain K_drop and the multiplying factor for the pixels 6 in the first region 3. The above-described operation of the processing circuitry 37 enables determining the pixel luminance for the luminance value Lux (or the desired display brightness level) in light of the difference in the display characteristics between the first region 3 and the second region 4.

The accumulator circuitry 22 is configured to accumulate or sum up the pixel luminances of the respective pixels 5 and 6 for the entire display panel 1 to determine the total luminance. The total luminance corresponds to the total current of the display panel 1, since the luminance of each pixel corresponds to the current traveling through the pixel. In one implementation, the IR-drop compensation is performed based on the total luminance determined by the accumulator circuitry 22 to reflect the total current of the display panel 1.

The compensation coefficient determination circuitry 23 is configured to generate one or more compensation coefficients used for the IR-drop compensation for each pixel of interest (pixel 5 or 6) based on the total luminance and the location of the pixel of interest. The location of the pixel of interest may be indicated by the coordinates (X, Y) defined in the display panel 1. In one implementation, the compensation coefficient determination circuitry 23 includes area gain generator circuitry 41, location-dependent gain generator circuitry 42, and processing circuitry 43.

The area gain generator circuitry 41 is configured to generate an area gain K_area based on the total luminance determined by the accumulator circuitry 22. In one implementation, the area gain generator circuitry 41 may include an area gain LUT 41*a*, and the area gain generator circuitry 41 is configured to generate the area gain K_area through a table lookup on the area gain LUT 41*a* with reference to the total luminance.

The location-dependent gain generator circuitry 42 is configured to generate a location-dependent gain K_loc for each subpixel of the pixel of interest based on the coordinates (X, Y) of the pixel of interest. In one implementation, the location-dependent gain generator circuitry 42 may include an location-dependent gain LUT 42*a*, and the location-dependent gain generator circuitry 42 is configured to generate the location-dependent gain K_loc through a table lookup on the location-dependent gain LUT 42*a* with reference to the coordinates (X, Y) of the pixel of interest.

The processing circuitry 43 is configured to determine the compensation coefficient for each subpixel of the pixel of interest based on the area gain K_area and the corresponding location-dependent gain K_loc. In one or more embodiments, the compensation coefficient determined for each subpixel of the pixel of interest is defined as a compensation gain, and the processing circuitry 43 may be configured as a multiplier that generate the compensation gain for each subpixel of the pixel of interest by multiplying the area gain K_area and the corresponding location-dependent gain K_loc. In such embodiments, the IR-drop compensation may be achieved by multiplying the voltage value obtained by the gamma transformation for each subpixel of the pixel of interest by the corresponding compensation gain.

Figure 10:
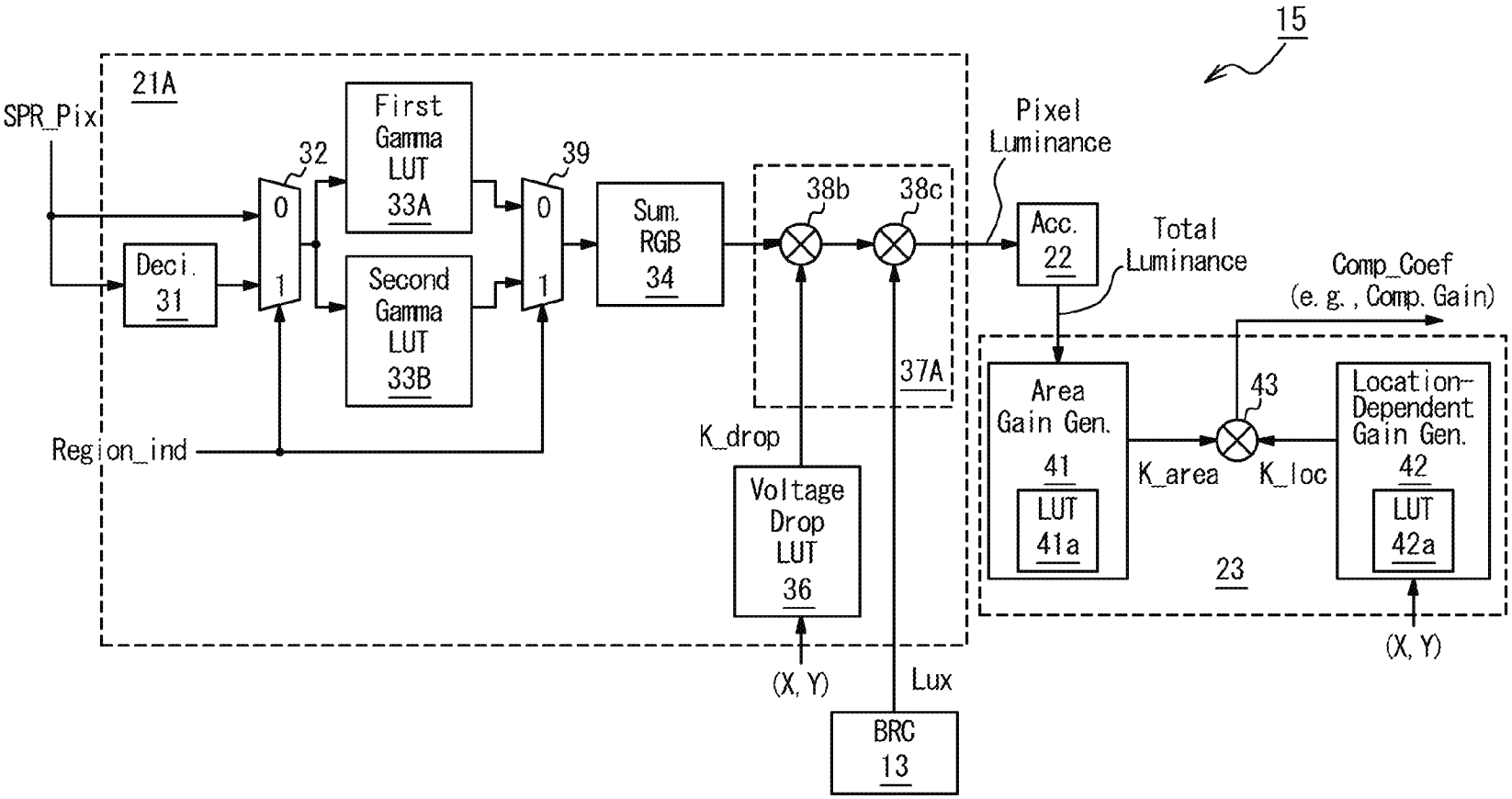
FIG. 10 illustrates an example configuration of IR-drop compensation circuitry, according to other embodiments.

FIG. 10 illustrates an example configuration of the IR-drop compensation circuitry 15, according to other embodiments. In the illustrated embodiment, the IR-drop compensation circuitry 15 includes first gamma LUT circuitry 33A, second gamma LUT circuitry 33B, and a selector 39.

The first gamma LUT circuitry 33A is adapted to a gamma transformation for the pixels 6 in the first region 3. The first gamma LUT circuitry 33A is configured to apply a gamma transformation to the image data received from the selector 32 (the subpixel-rendered image data SPR_Pix or the output image data from the decimation circuitry 31) to determine the luminances of the respective subpixels of the pixel of interest through a table lookup on a first LUT stored therein for each subpixel of the pixel of interest. In one implementation, the first LUT stored in the first gamma LUT circuitry 33A may describe a correlation of grayscale values and luminances for the pixels 6 in the first region 3.

The second gamma LUT circuitry 33B is adapted to a gamma transformation for the pixels 5 in the second region 4. The second gamma LUT circuitry 33B is configured to apply a gamma transformation to the image data received from the selector 32 to determine the luminances of the respective subpixels of the pixel of interest through a table lookup on a second LUT stored therein for each subpixel of the pixel of interest. In one implementation, the second LUT stored in the second gamma LUT circuitry 33B may describe a correlation of grayscale values and luminances for the pixels 5 in the second region 4.

The selector 39 is configured to select one of the outputs from the first gamma LUT circuitry 33A and the second gamma LUT circuitry 33B in response to the region indication signal Region_ind and output the selected output, which indicates the luminances of the respective subpixels of the pixel of interest. In one implementation, the selector 39 is configured to select the output from the first gamma LUT circuitry 33A in response to the region indication signal Region_ind being activated and select the output from the second gamma LUT circuitry 33B in response to the region indication signal Region_ind being deactivated.

The summation circuitry 34 is configured to sum up the luminances of the respective subpixels of the pixel of interest received from the selector 39 to determine the pixel luminance of the pixel of interest for the maximum display brightness level.

The processing circuitry 37A is configured to determine the pixel luminance of the pixel of interest, based on the voltage drop compensation gain K_drop received from the voltage drop LUT 36 and the luminance value Lux from BRC 13. In one implementation, the processing circuitry 37A is configured to multiply the pixel luminance output from the summation circuitry 34 by a gain determined based on the voltage drop compensation gain K_drop and the luminance value Lux. In the illustrated embodiment, the processing circuitry 37A includes a multiplier 38*b* configured to multiply the pixel luminance output from the summation circuitry 34 by the voltage drop compensation gain K_drop, and a multiplier 38*c* configured to multiply the output of the multiplier 38*b* by a multiplying factor that depends on the luminance value Lux.

The configuration of the IR-drop compensation circuitry 15 illustrated in FIG. 10 also enables determining the pixel luminance for the luminance value Lux (or the desired display brightness level) in light of the difference in the display characteristics between the first region 3 and the second region 4.

Figure 11:
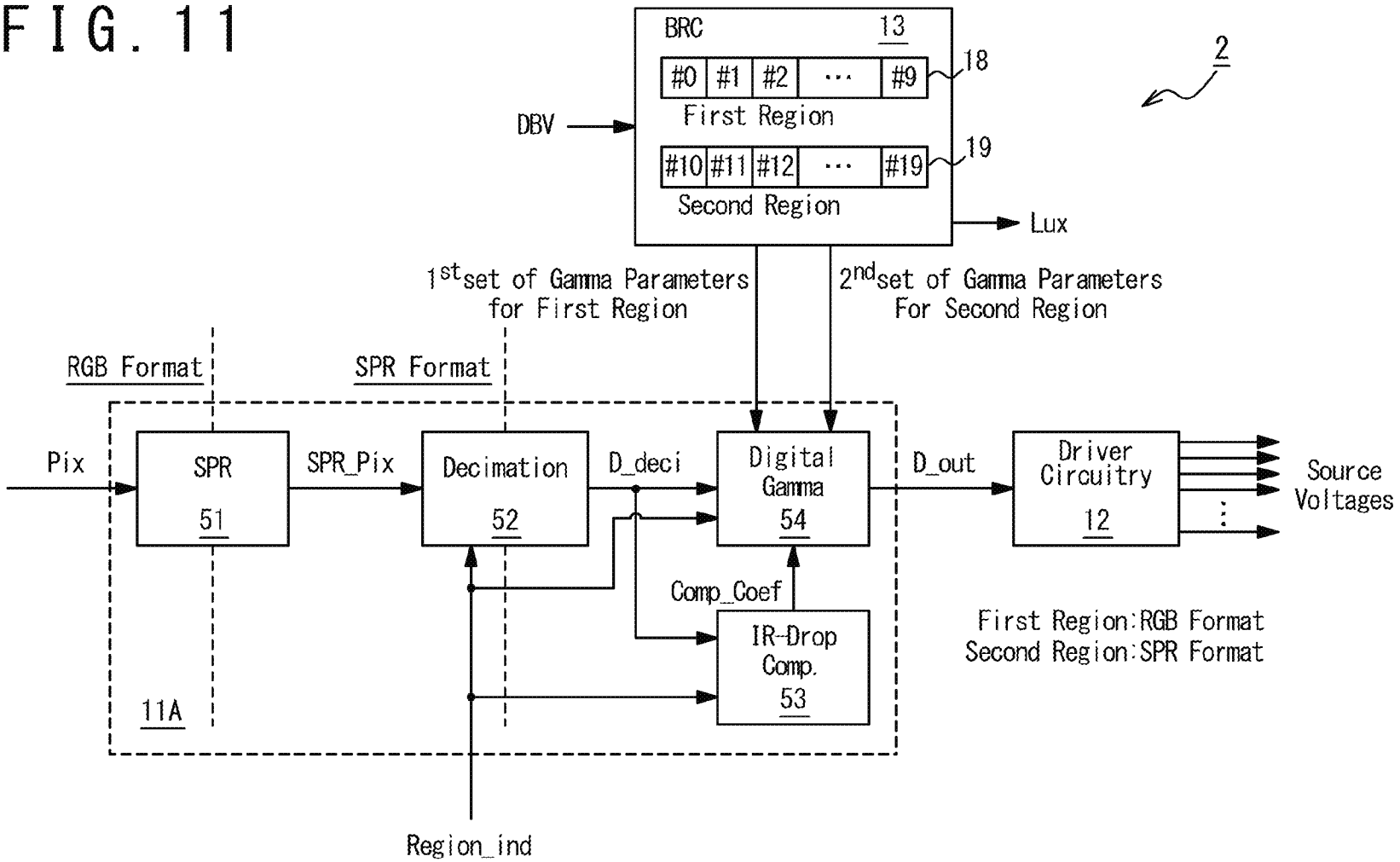
FIG. 11 illustrates an example partial configuration of a display driver, according to one or more embodiments.

FIG. 11 illustrates an example partial configuration of the display driver 2, according to other embodiments. In the illustrated embodiment, image processing circuitry 11A includes SPR circuitry 51, decimation circuitry 52, IR-drop compensation circuitry 53, and digital gamma circuitry 54. The SPR circuitry 51 is configured to apply subpixel rendering to the input image data Pix to generate subpixel-rendered image data SPR_Pix. The subpixel-rendered image data SPR_Pix may be generated in a format adapted to the pixel layout of the second region 4. The subpixel-rendered image data SPR_Pix may include grayscale values for an R subpixel, two G subpixels, and a B subpixel for each pixel.

The decimation circuitry 52 is configured to decimate part of the subpixel-rendered image data SPR_Pix to generate decimated image data D_deci. The decimation is performed differently between the first region 3 and the second region 4. For the pixels 5 in the second region 4, the decimation circuitry 52 is configured to use the subpixel-rendered image data SPR_Pix as the decimated image data D_deci without modification. For the pixels 6 in the first region 3, the decimation circuitry 52 is configured to decimate part of the subpixel-rendered image data SPR_Pix to generate the decimated image data D_deci.

The IR-drop compensation circuitry 53 is configured to generate compensation coefficients Comp_Coef used for the IR-drop compensation for the respective pixels in the display panel 1 based on the decimated image data D_deci. The compensation coefficients Comp_Coef are provided to the digital gamma circuitry 54.

The digital gamma circuitry 54 is configured to apply a gamma transformation and an IR-drop compensation to the decimated image data D_deci to generate the output voltage data D_out. In some embodiments, the gamma transformation converts grayscale values of the decimated image data D_deci into voltage values, and the IR-drop compensation modifies the voltage values acquired by the gamma transformation based on the compensation coefficients Comp_Coef to generate the voltage values of the output voltage data D_out. In other embodiments, the IR-drop compensation may be performed before the gamma transformation. In such embodiments, the IR-drop compensation may modify the grayscale values of the decimated image data D_deci, and the gamma transformation converts the modified grayscale values into the voltage values of the output voltage data D_out.

Figure 12:
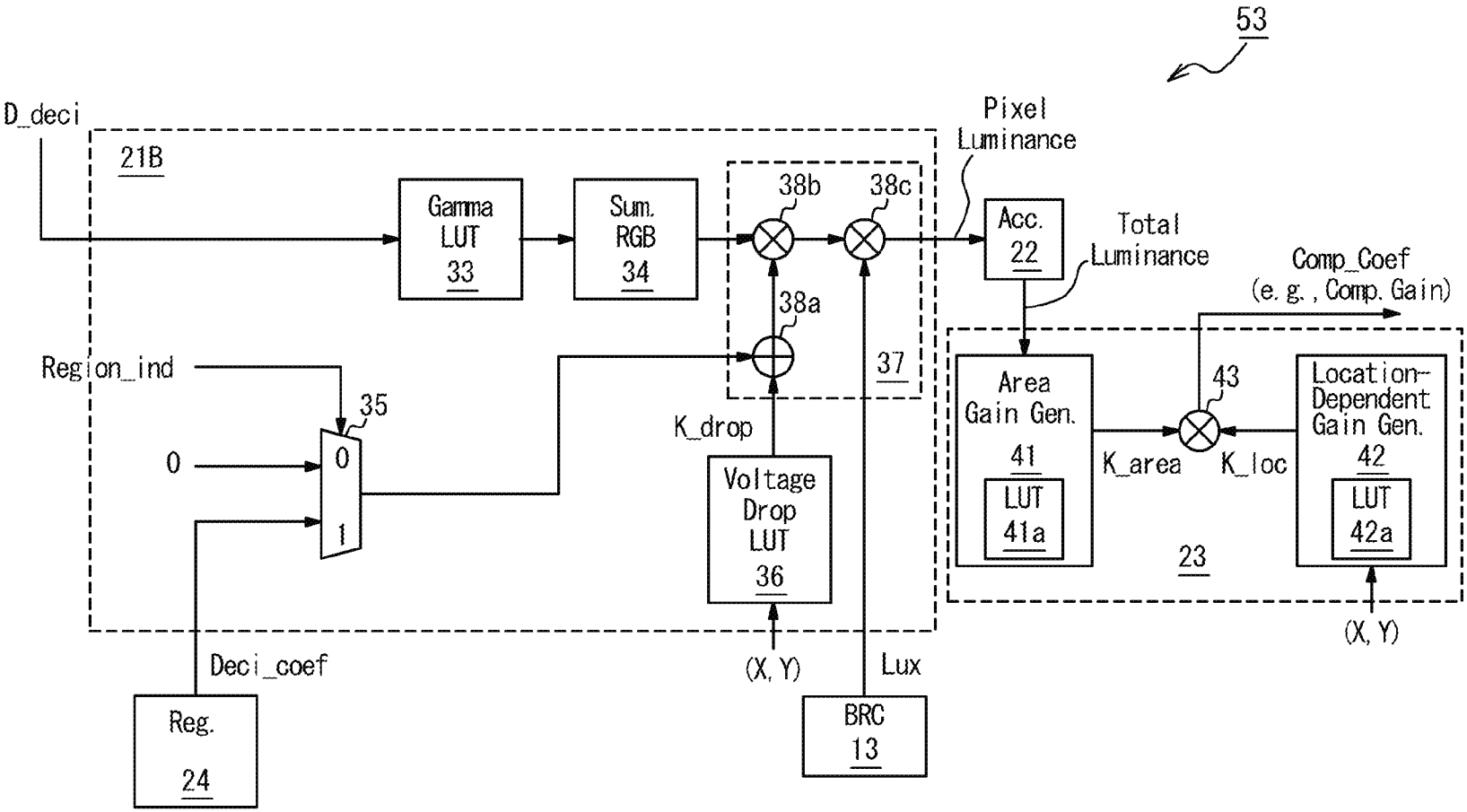
FIG. 12 illustrates an example configuration of IR-drop compensation circuitry, according to one or more embodiments.

FIG. 12 illustrates an example configuration of the IR-drop compensation circuitry 53 of the image processing circuitry 11A illustrated in FIG. 11, according to one or more embodiments. In the illustrated embodiment, the IR-drop compensation circuitry 53 is configured similarly to the IR-drop compensation circuitry 15 illustrated in FIG. 9 except for that the pixel luminance determination circuitry 21B does not include the decimation circuitry 31 and the selector 32. The Gamma LUT circuitry 33 is configured to apply a gamma transformation to the decimated image data D_deci to determine the luminances of the respective subpixels of the pixel of interest through a table lookup on an LUT stored therein for each subpixel of the pixel of interest. The rest of the pixel luminance determination circuitry 21B is configured identically to the pixel luminance determination circuitry 21 illustrated in FIG. 9.

Figure 13:
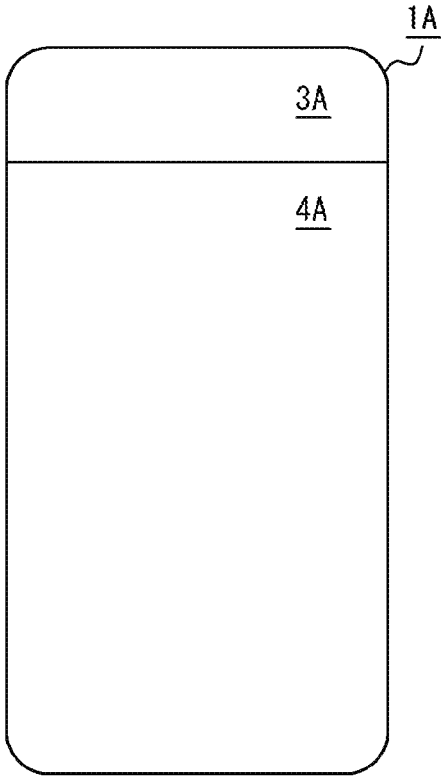
FIG. 13 illustrates an example configuration of a display panel, according to one or more embodiments.

FIG. 13 illustrates an example configuration of a display panel 1A, according to other embodiments. In the illustrated embodiment, the display panel 1A includes a first region 3A and a second region 4A which have different pixel layouts. The first region 3A is disposed at the top end of the display panel 1A. In some embodiments, the first region 3A is configured such that the pixel density of the first region 3A is lower than that of the second region 4A, and various devices, such as, a camera, a speaker, and sensors are disposed under the first region 3A. This configuration may reduce an effect of the pixels of the display panel 1 on the devices disposed under the display panel 1.

Figure 14:
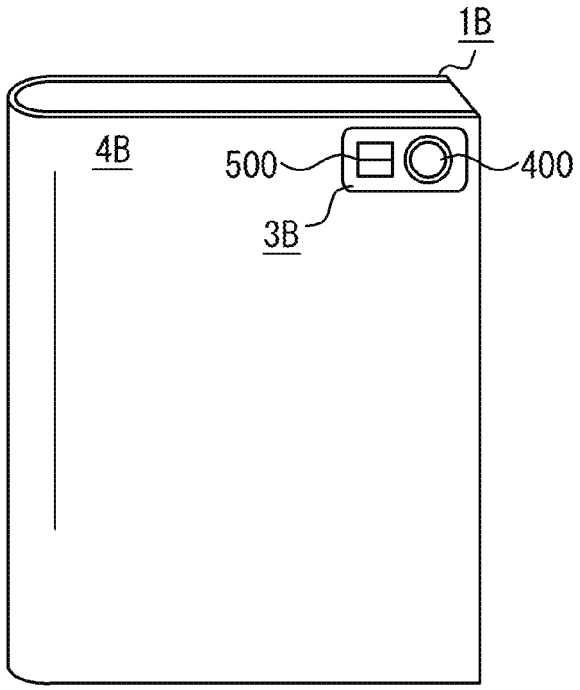
FIG. 14 illustrates an example configuration of a display panel, according to other embodiments.

FIG. 14 illustrates an example configuration of a foldable display panel 1B, according to still other embodiments. In the illustrated embodiment, the foldable display panel 1B is incorporated in an electronic device (e.g., a smart phone, a cell phone, and other types of portable devices). The foldable display panel 1B includes a first region 3B and a second region 4B. The pixel density in the first region 3B is lower than the second region 4B. The second region 4B is configured such that at least part of the second region 4B is foldable. A camera 400 and an illumination lamp 500 are disposed behind the first region 3B to be opposed to the inner face of the foldable display panel 1B. The camera 400 is configured to capture an image of a target object through the first region 3B. The illumination lamp 500 is configured to emit light through the first region 3B to illuminate the target object. In one implementation, the illumination lamp 500 comprises a flash lamp configured to emit flash light. This configuration may reduce an effect of the pixels of the display panel 1 on an image captured by the camera 400 and/or light emitted by the illumination lamp 500.

Figure 15:
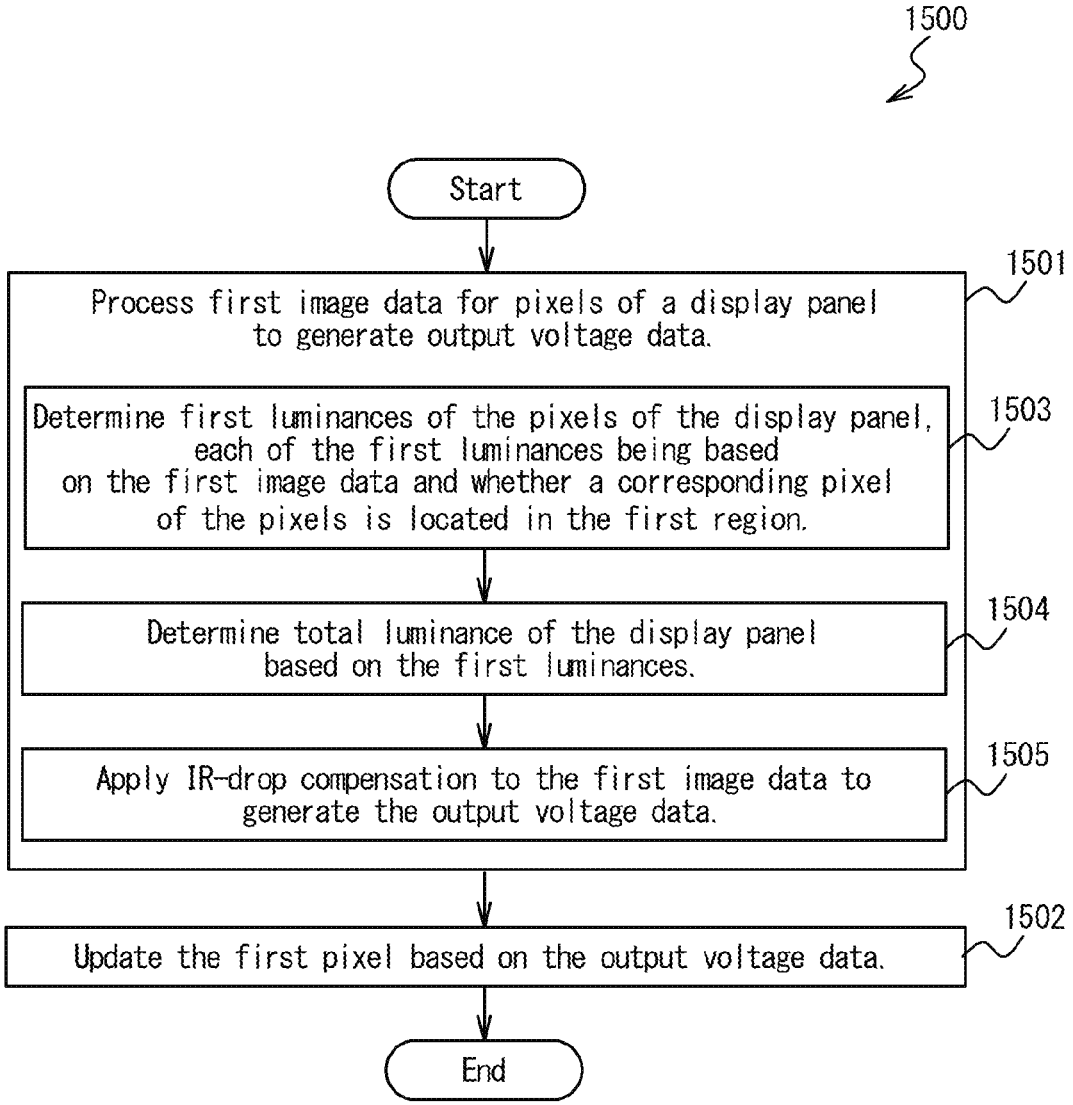
FIG. 15 illustrates an example method for driving a display panel, according to one or more embodiments.

Method 1500 of FIG. 15 illustrates steps for driving a display panel (e.g., the display panels 1, 1A, and 1B illustrated in FIGS. 1, 2, 13 and 14), according to one or more embodiments. It should be noted that the order of the steps may be altered from the order illustrated.

In the illustrated embodiment, first image data (e.g., the subpixel-rendered image data SPR_Pix illustrated in FIG. 7) are processed to generate output voltage data (e.g., output voltage data D_out) for pixels of a display panel (e.g., the display panel 1 illustrated in FIG. 1) at step 1501. The display panel includes a first region (e.g., the first region 3) and a second region (e.g., the second region 4) which have different pixel layouts. This is followed by updating the pixels of the display panel based on the output voltage data at step 1502.

In the processing of the first image data at step 1501, first luminances of the pixels of the display panel are determined, each of the first luminances being based on the first image data and whether the corresponding pixel of the pixels is located in the first region at step 1503. At step 1504, the total luminance of the display panel is further determined based on the first luminances of the pixels of the display panel. The total luminance may be the sum of the first luminances of all the pixels of the display panel. At step 1505, an IR-drop compensation may be applied to the first image data to generate the output voltage data based on the total luminance of the display panel. Since the first luminances of the pixels of the display panel may well reflect the currents traveling through the pixels of the display panel, the use of the first luminances may effectively improve preciseness of the IR-drop compensation.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display driver, comprising:

image processing circuitry configured to process first image data for pixels of a display panel comprising a first region and a second region to generate output voltage data, the first region and the second region having different pixel layouts; and driver circuitry configured to update the pixels based on the output voltage data, wherein processing the first image data comprises:

decimating the first image data in the first region to generate output image data in the first region, using the first image data in the second region undecimated to generate the output image data for the second region, calculating a total luminance across the entire display panel, wherein the total luminance corresponds to a total current of the display panel, calculating, for each pixel in the first region and in the second region, an IR-drop compensation using the total luminance and based on first luminances of the pixels, each of the first luminances being determined separately for a first subset of the pixels located in the first region and a second subset of the pixels located in the second region, and based on the first image data, and generating the output voltage data by applying a first gamma transformation and the IR-drop compensation to the output image data for the first region and the second region.

2. The display driver of claim 1, wherein the first region has a lower pixel-per-inch (PPI) than that of the second region.

3. The display driver of claim 1, wherein the first region comprises a camera hole region under which a camera is disposed.

4. The display driver of claim 1, wherein a luminance of a first pixel in the first region and a luminance of a second pixel in the second region are different for a same output voltage.

5. The display driver of claim 1, wherein the total luminance is determined based on the first luminances of the pixels of the display panel.

6. The display driver of claim 1, wherein the IR-drop compensation is based on a location of each of the pixels.

7. The display driver of claim 1, wherein processing the first image data further comprises:

determining second luminances of the pixels of the display panel by applying a second gamma transformation to the first image data;

determining the first luminances of the pixels for a desired display brightness level of the display panel by multiplying each of the second luminances of the pixels by a factor determined based on whether each of the pixels is located in the first region; and determining the total luminance of the display panel based on the first luminances of the pixels.

8. The display driver of claim 1, wherein processing the first image data further comprises:

decimating part of the first image data to generate decimated image data;

determining second luminances of the pixels of the display panel through a first gamma transformation of the decimated image data;

determining the first luminances of the pixels for a specified display brightness level of the display panel by multiplying each of the second luminances of the pixels by a factor determined based on each of the pixels is located in the first region; and determining the total luminance of the display panel based on the first luminances of the pixels.

9. The display driver of claim 1, wherein processing the first image data further comprises:

decimating part of the first image data to generate decimated image data;

determining second luminances of the pixels of the display panel by applying a gamma transformation to the decimated image data, the gamma transformation being based on a first gamma look-up table (LUT) for pixels in the first region and based on a second gamma LUT for pixels in the second region;

determining the first luminances of the pixels for a specified display brightness level of the display panel by multiplying each of the second luminances of the pixels by a factor determined based on each of the pixels is located in the first region; and determining the total luminance of the display panel based on the first luminances of the pixels.

10. The display driver of claim 1, wherein the image processing circuitry is further configured to generate the first image data through subpixel rendering of input image data.

11. The display driver of claim 1, wherein the image processing circuitry is further configured to:

generate subpixel-rendered image data through subpixel rendering of input image data; and generate the first image data by decimating part of the subpixel-rendered image data.

12. A display device, comprising:

a display panel comprising a first region and a second region having different pixel layouts; and a display driver configured to:

process first image data for pixels of the display panel to generate output voltage data; and drive circuitry configured to update the pixels based on the output voltage data, wherein processing the first image data comprises:

decimating the first image data in the first region to generate output image data in the first region, using the first image data in the second region undecimated to generate the output image data for the second region, calculating a total luminance across the entire display panel, wherein the total luminance corresponds to a total current of the display panel, calculating, for each pixel in the first region and in the second region, an IR-drop compensation using the total luminance and based on first luminances of the pixels of the display panel, each of the first luminances being determined separately for a first subset of the pixels located in the first region and a second subset of the pixels located in the second region, and based on the first image data, and generating the output voltage data by applying a first gamma transformation and the IR-drop compensation to the output image data for the first region and the second region.

13. The display device of claim 12, wherein the first region has a lower pixel-per-inch (PPI) than that of the second region.

14. The display device of claim 12, wherein the first region comprises a camera hole region under which a camera is disposed.

15. The display device of claim 12, wherein the total luminance is determined based on the first luminances of the pixels of the display panel.

16. The display device of claim 12, wherein processing the first image data further comprises:

determining second luminances of the pixels of the display panel by applying a second gamma transformation to the first image data;

determining the first luminances of the pixels for a specified display brightness level of the display panel by multiplying each of the second luminances of the pixels by a factor determined based on whether each of the pixels is located in the first region; and determining the total luminance of the display panel based on the first luminances of the pixels.

17. A method, comprising:

processing first image data for pixels of a display panel comprising a first region and a second region to generate output voltage data, the first region and the second region having different pixel layouts; and updating the pixels based on the output voltage data, wherein processing the first image data comprises:

decimating the first image data in the first region to generate output image data in the first region, using the first image data in the second region undecimated to generate the output image data for the second region, calculating a total luminance across the entire display panel, wherein the total luminance corresponds to a total current of the display panel, calculating, for each pixel in the first region and in the second region, an IR-drop compensation using the total luminance and based on first luminances of the pixels, each of the first luminances being determined separately for a first subset of the pixels located in the first region and a second subset of the pixels located in the second region, and based on the first image data, and generating the output voltage data by applying a second gamma transformation and the IR-drop compensation to the output image data for the first region and the second region.

18. The method of claim 17, wherein the first region comprises a camera hole region under which a camera is disposed.

* * * * *